United States Patent [19]

Fujio et al.

[11] Patent Number: 4,751,485

[45] Date of Patent: Jun. 14, 1988

[54] WATERPROOF SWITCH ASSEMBLY FOR ELECTRICAL APPLIANCES

[75] Inventors: Atsushi Fujio, Tokyo, Japan; Vito Carlucci, Stratford; Raymond Kunz, Monroe, both of Conn.

[73] Assignee: Clairol Incorporated, New York, N.Y.

[21] Appl. No.: 84,585

[22] Filed: Aug. 12, 1987

[51] Int. Cl.[4] ..... H01H 13/50

[52] U.S. Cl. ..... 335/206; 200/18; 200/157; 307/113; 361/357

[58] Field of Search ..... 361/189, 357, 42, 49; 335/206, 207; 307/113; 200/6 C, 18, 50 C, 61.85, 67 R, 67 D, 67 F, 157, 252, 283, 292, 33 D, 81.9 M

[56] References Cited

U.S. PATENT DOCUMENTS

| | | | |
|---|---|---|---|
| 1,958,482 | 5/1934 | Leins | 337/3 |
| 3,689,859 | 9/1972 | Straub | 335/206 |
| 4,150,350 | 4/1979 | Fong | 335/206 |
| 4,464,582 | 8/1984 | Aragaki | 361/42 |
| 4,589,047 | 5/1986 | Gaus | 361/42 |

*Primary Examiner*—G. P. Tolin

*Attorney, Agent, or Firm*—Gene Warzecha

[57] ABSTRACT

A dual compartment magnetic switch interposed between a hand held electrical appliance and its electrical power input. The magnetic switch enables electrical power to be totally insulated from the electrical components within the appliance so that when the appliance is in the off position, user safety is enhanced.

13 Claims, 7 Drawing Sheets

120
122
84
92
80
124
76
90
12
14
18
100
81
26
82
110
79
20
70
77
28
58
46
42
32
40
51
50
24
62
36
60

122
72
74
98
100
102
104
110
33
60
62
60

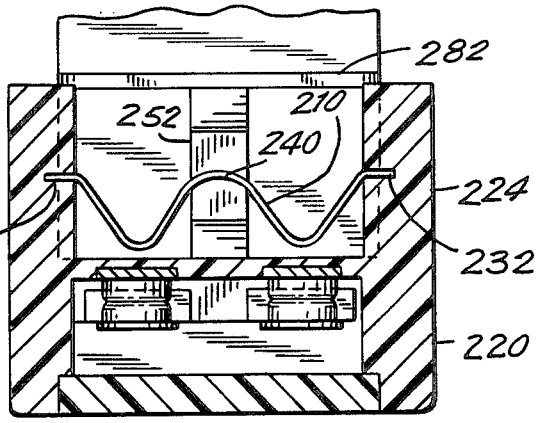
FIG. 10
FIG. 11
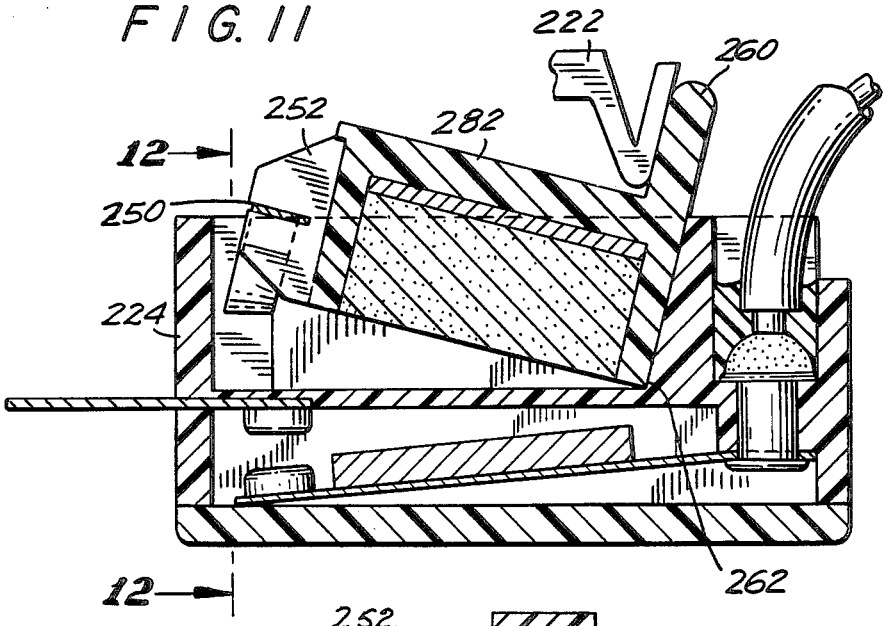
FIG. 12
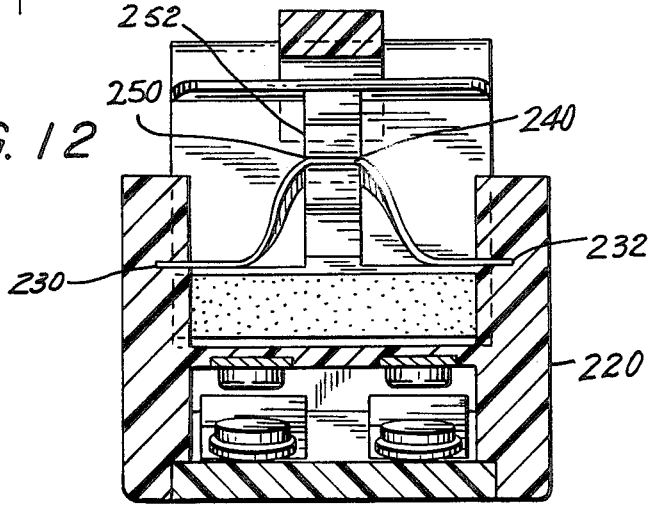

WATERPROOF SWITCH ASSEMBLY FOR ELECTRICAL APPLIANCES

BACKGROUND OF THE INVENTION

1. Field of the Invention

The invention relates to switches for small, hand-held electrical appliances. In particular, the invention relates to waterproof electrical power switches in which the electrical contacts are hermetically sealed. Even more particularly, the invention relates to magnetically operated electrical power switches.

2. Description of the Prior Art

Hand-held hair dryers and similar small electrical appliances are often used in environments creating some risk that the appliances will come into contact with water thereby creating the danger of electrocution or serious shock to the user. These dangers exist with respect to A.C. powered appliances whether or not the power switch of the appliance is on or off because of the presence of electrical potential on the conductive parts within the appliance. The use of a double pole waterproof switch eliminates these dangers when the appliance is turned off, but such switches are difficult to manufacture within all of the constraints dictated by the environment in which these switches must be used.

Some prior art shock hazard protectors are known which shut off power to the appliance when it comes into contact with water. These devices generally have two main features; a sensor means to sense the danger causing condition and an actuator means to rapidly open the power lines. U.S. Pat. No. 4,464,582, for example, shows an automatic power shut-off circuit which utilizes a pair of flexible metallic conductors spaced apart a predetermined distance and secured to an electrical appliance in a labyrinthine pattern. When water bridges the space, the circuit energizes a solenoid to open a pair of switches in the power line to the appliance. Both sensing and actuation portions of this device are too costly and complex to be incorporated in relatively low cost electrical appliances.

Another type of shock hazard protector is shown in U.S. Pat. No. 4,589,047 (Gaus). The sensor part of the device shown in this application is a two-wire circuit arranged at the edges of openings and joints through which water may penetrate. The device also includes a triac having a circuit responsive to the sensor. The actuator part of the device is a self-opening mechanical switch which is normally held closed by a fusible wire which is melted upon the firing of the triac. The actuator part of this device is complex and relatively costly for use in small appliances. The sensor part of this device requires several circuit components and must be triggered by a water bridge across the two-wire circuit. The sensor is, therefore, also relatively costly.

The complexity of the aforementioned patents results because the devices are intended to turn power off to the small appliance when water bridges a pair of sensor wires before it touches any high voltage parts of the appliance. The complexity and high cost of these devices inhibits their use in small appliances.

Accordingly, there is a need for a safe shock hazard protector which is sufficiently inexpensive so that it may be included in relatively low cost appliances such as hair dryers, curling irons, and the like.

In certain small appliances, it is desirable to provide some electrical protection for the user without the attendant cost and complexity of the foregoing devices.

As a minimum, therefore, it is desirable to provide a means by which electrical power could be absolutely insulated within an electrical appliance until its use. As mentioned above, hermetically sealed waterproof power switches have been used in some prior art applications with some success. However, in certain small hand-held appliances such as hair dryers, the necessary size of such switches and the physical constraints within the hair dryers prohibit the use of available waterproof switches. Additionally, hair dryers very often have a plurality of power settings, for example, "off", "low", "medium", "high" and providing a totally waterproof switch capable of operating in all these modes has not heretofore been possible.

It is known to use magnetic reed switches in hermetically sealed containers. U.S. Pat. No. 1,958,482 (Leins), for example, shows a glass container enclosing a stationary electrical contact and a movable electrical contact attached to the end of a flexible cantilevered spring member which has an armature secured thereto. An external magnet may be moved in close proximity to the casing to attract the armature and thereby close the switch. While such an arrangement might be suitable for some appliances, all known small magnetic switches are relatively unstable for use in environments such as small hand-held appliances which are subject to being dropped or roughly handled because the switches may tend to open or close unpredictably.

It is accordingly an object of this invention to provide a waterproof switch capable of eliminating any possible exposure of live electrical parts of a hair appliance to water unless the power switch is on.

SUMMARY OF THE INVENTION

These and other objects of the invention are achieved by a dual compartment magnetic switch comprising, a hermetically sealed first compartment comprising within said first compartment, a pair of first electrical contacts, said first contacts each having a portion thereof outside said first compartment; a pair of longitudinally electrically conductive spring means each attached at one end thereof to said compartment, said leaf spring means each having a free end normally spaced from and biased away from a respective one of said first contacts; a pair of second electrical contacts respectively secured to the free ends of said pair of leaf spring means and adapted to be moved with said leaf spring means between a closed position in contact with a respective one of said first electrical contacts, and an open position away from same; and a pair of magnetically attractive means secured respectively to each of said leaf spring means; and further comprising an adjacent, second compartment comprising magnet means movable between (1) a first position for attracting both of said magnetically attractive means and overcoming the normal bias of said leaf spring means, thereby causing each of said pair of second electrical contacts to close with a respective one of each of said first electrical contacts, and (2) a second position to decrease the attraction between said magnet means and both of said magnetically attractive means to open the contacts; spring means adjacent said magnet means for normally biasing said magnet means in said second position, said spring means being compressible during transition of said magnet means between said first and second positions; and actuating means for selectively moving said magnet means from said second position to said first position.

BRIEF DESCRIPTION OF THE DRAWINGS

FIG. 10 is a left side view of FIG. 9 taken along the lines 10—10.

FIG. 11 is a view similar to FIG. 9 but showing the switch in an open position.

FIG. 12 is a left end view of FIG. 11 taken along the lines 12—12 showing the magnetic switch in an open position.

DESCRIPTION OF THE PREFERRED EMBODIMENT

Figure 1:
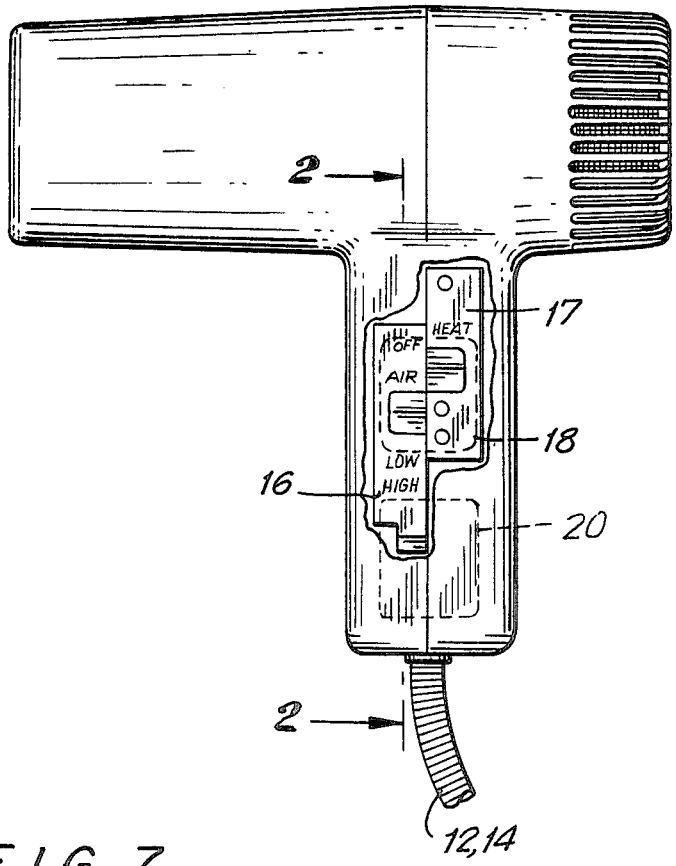
FIG. 1 is a diagrammatic side elevational view of a hair dryer, partially cut-away to show part of a magnetic switch (in phantom) constructed in accordance with the principles of this invention.
Figure 7:
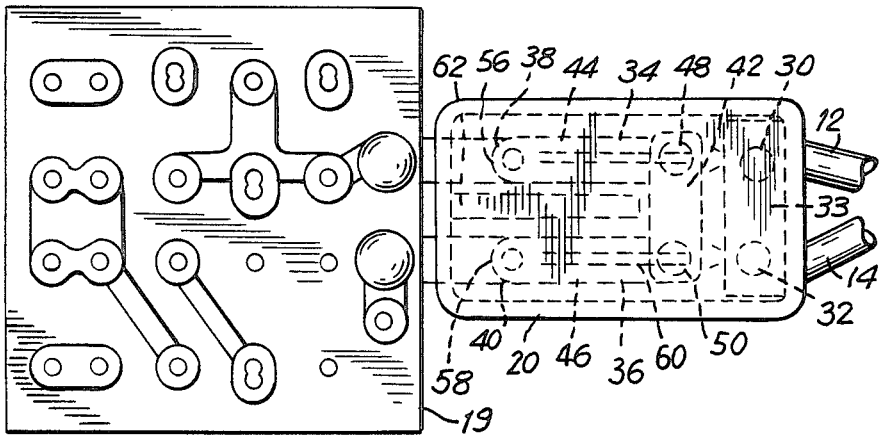
FIG. 7 is a bottom plan view of a portion of FIG. 2 taken along the lines 7—7.
Figure 2:
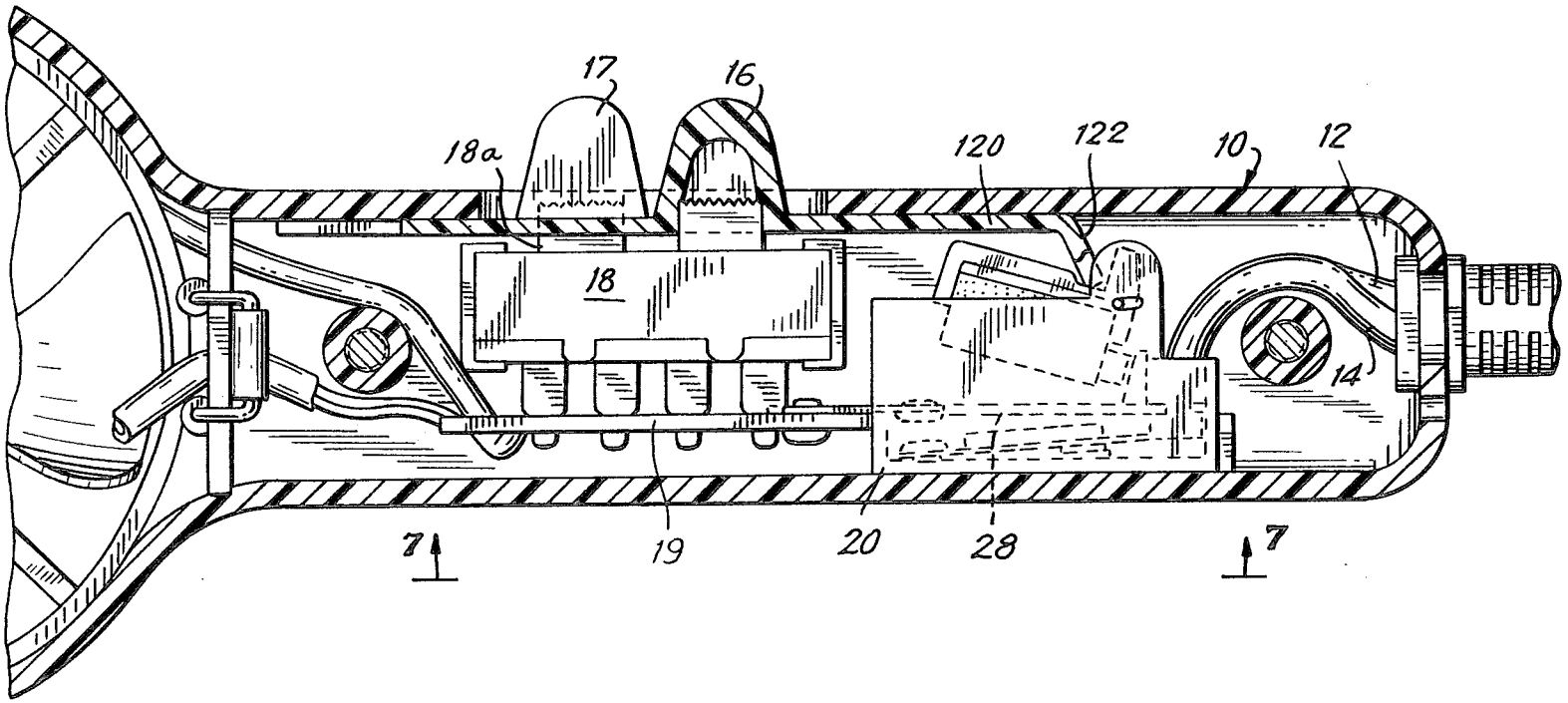
FIG. 2 is a cross-sectional view of FIG. 1 taken along the line 2—2 showing a magnetic switch constructed in accordance with the principles of this invention.

Referring now to FIGS. 1 and 2, there is shown an elevational cut-away view, and a cross-sectional view respectively of an electrical hand-held appliance 10 (in this case, a hair dryer). Appliance 10 is provided with a pair of electrical power input lines 12, 14, slide switch caps 16 and 17 and a conventional power on/off switch 18. Magnetic switch 20, constructed in accordance with the principles of the invention, is interposed between power lines 12, 14 and power switch 18. Printed circuit board 19 is connected to a magnetic switch 20 and to power switch 18 to accomodate some of the wiring connections in the appliance.

As will be better understood below, the invention enables the appliance to be set into different modes while still not detracting from the advantages offered by the invention. For example, cap 16, when in the off position (at the bottommost point of its travel as viewed in FIG. 1) will, as will be understood below, disconnect electrical power from the appliance. As the cap 16 is moved upwardly, the magnetic switch will be closed while still enabling the appliance to be set in different modes, i.e. low and high. Additionally, cap 17 controls a separate switch 18*a* (only partially visible in FIG. 2) and is independently operable of cap 16 and its associated power switch 18.

Figure 3:
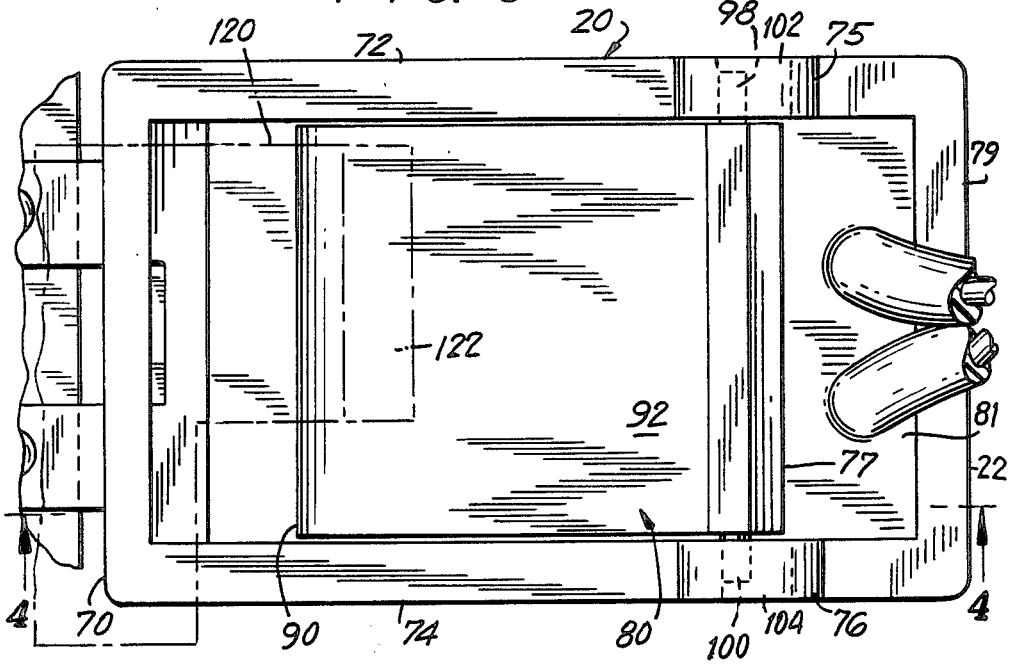
FIG. 3 is a plan view of the magnetic switch of FIG. 2.
Figure 4:
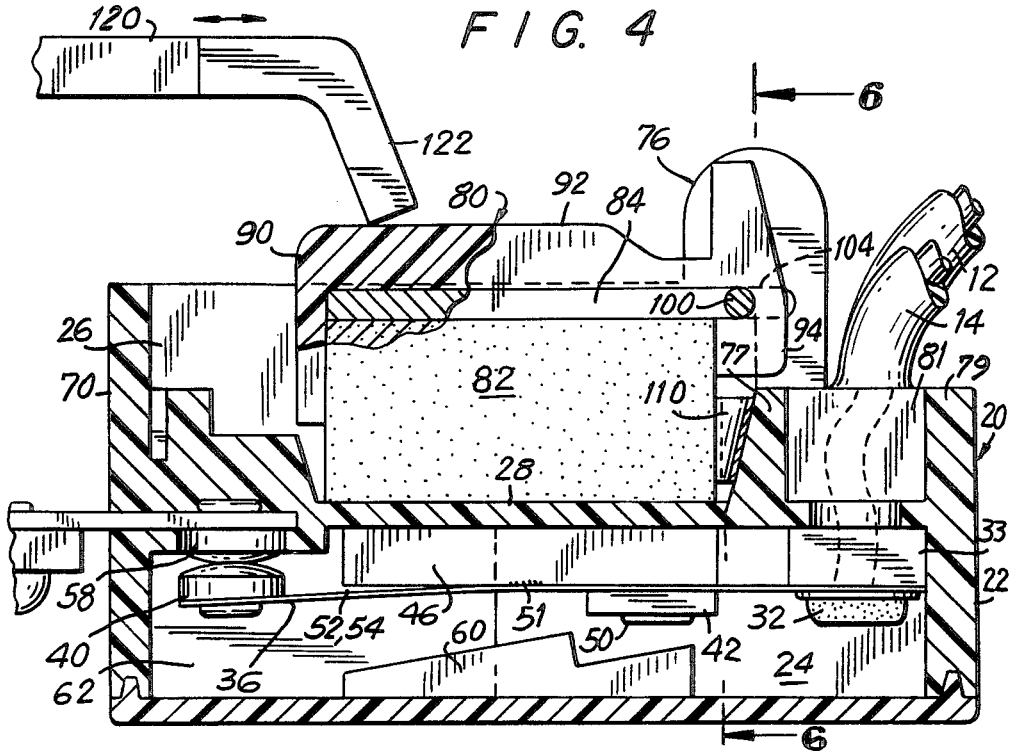
FIG. 4 is a side elevational view of the magnetic switch of FIG. 3 taken along the lines 4—4 showing the switch in a closed position.

As best seen in FIGS. 3 and 4, magnetic switch 20 comprises a dual compartment housing 22 formed into a hermetically sealed lower compartment 24 and an adjacent open compartment 26. Compartments 24 and 26 are separated by a common dividing wall 28.

Lower compartment 24 includes a pair of terminals 30 and 32, each respectively connected to a power input line 12 and 14. Terminals 30 and 32 are at the bottom of respective apertures in insulating spacer block 33. Also connected to terminals 30 and 32 are the ends of leaf springs 34 and 36, the other ends of the leaf springs having attached thereto movable electrical contacts 38 and 40, respectively. Leaf springs 34 and 36 are joined intermediate their ends by an insulated reinforcing member 42 secured to the bottom of the leaf springs. Member 42 serves to assure that contacts 34 and 36 move essentially simultaneously. This results in each contact 34 and 36 being randomly closed ahead of the other, thereby producing relatively even wear of each pair of contacts 38, 56 and 40, 58 (explained below). It is important that the contacts be adjusted to close essentially simultaneously to produce even wear. Otherwise, after repeated use the non-wearing pair of contacts would prevent the worn pair of contacts from closing.

Each leaf spring is also provided intermediate its ends with an armature or metallic plate 44 and 46 which, as will be understood below, serves to enhance the magnetic attraction of the leaf springs. The metallic plates 44 and 46 and the insulated member 42 may be attached to the leaf springs by rivets 48 and 50 and/or spot welds 51 to limit rotation about the rivet point. It should be noted that metallic plates 44 and 46 are generally longitudinal and are attached to their respective leaf springs at only one end of the plates, the other end of the metallic plates, in the areas 52 and 54 are free to move away from the leaf springs as will be understood below.

Also enclosed in lower compartment 24 is a pair of fixed electrical contacts 56 and 58 which provide the mating surfaces for movable contacts 38 and 40 when magnetic switch 20 is in the closed position. Contacts 56 and 58 each have extensions protruding through the front wall of housing 22 in order to connect the contacts to printed circuit board 19. The area over contacts 56 and 58 is thicker than other parts of housing 22 in order to provide adequate insulation.

A ramp member 60, situated under each leaf spring, and a separating wall 62 are also molded into lower compartment 24, the purposes of which will be explained below.

Referring now to upper compartment 26, it is noted that this upper compartment is, in the preferred embodiment, not hermetically sealed and indeed need not even be a compartment per se. However, in the preferred embodiment this compartment 26 functions as a means to which various components of magnetic switch 20 may be attached. Compartment 26 comprises a front wall 70, a pair of parallel side walls 72 and 74, each having at an intermediate point along its length raised ear portions 75 and 76, respectively. Rear wall 79 is joined to the opposite ends of parallel walls 72 and 74 and an intermediate transverse wall 77 is situated therebetween. The walls 70, 72, 74 and 79 are integrally formed with corresponding walls of lower compartment 24. Situated between parallel walls 72 and 74 is a magnet holder 80 holding a magnet 82 and a flux return plate 84. Magnet holder 80 is a three sided structure having a front wall 90, top wall 92, and rear wall 94. Magnet 82 is adhesively or otherwise secured between front wall 90 and rear wall 94.

The area bounded by rear wall 79, transverse wall 77, the intervening portions of side walls 72 and 74 and common separating wall 28 is filled with epoxy or potting compound 81 around power lines 12 and 14 to provide spacing, alignment and insulation.

Figure 5:
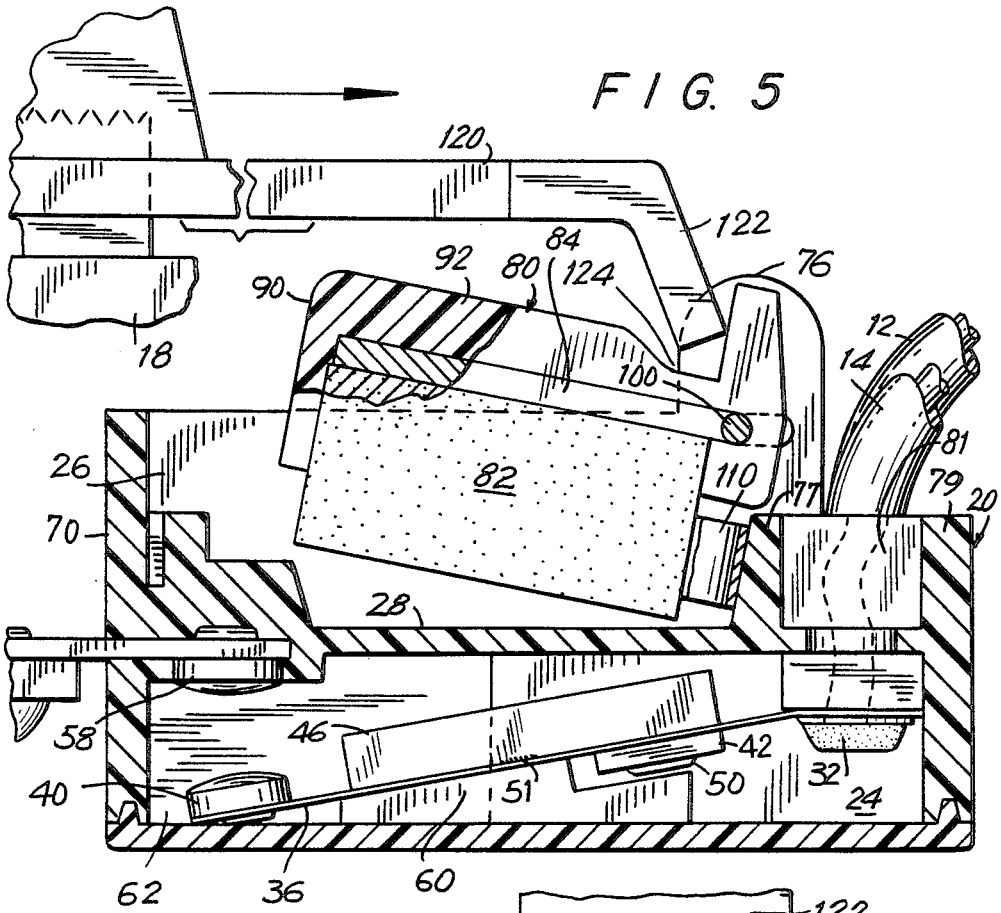
FIG. 5 is a side elevational view of the magnetic switch in an open position.
Figure 6:
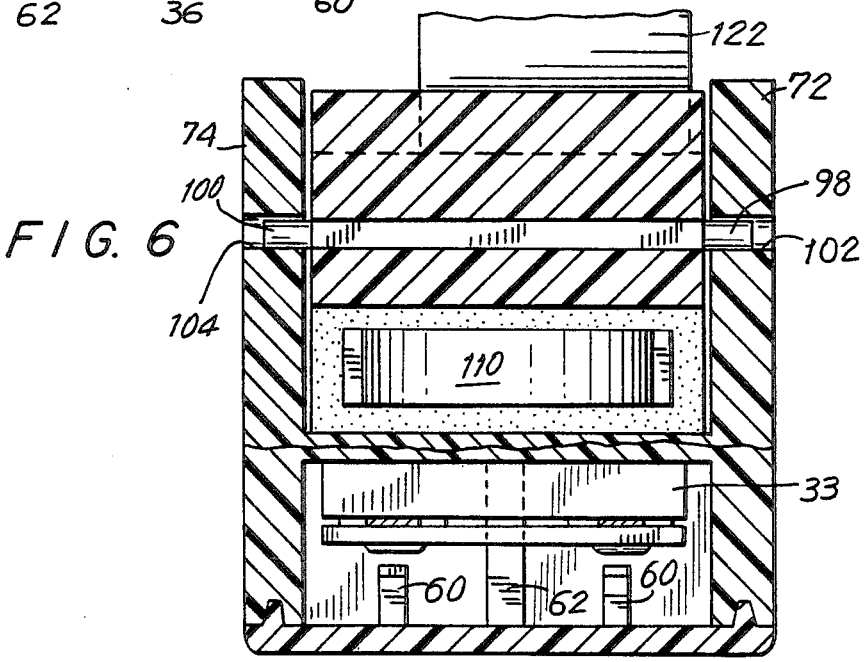
FIG. 6 is a right end elevational view of the switch taken along the lines 5—5 of FIG. 3.
Figure 8:
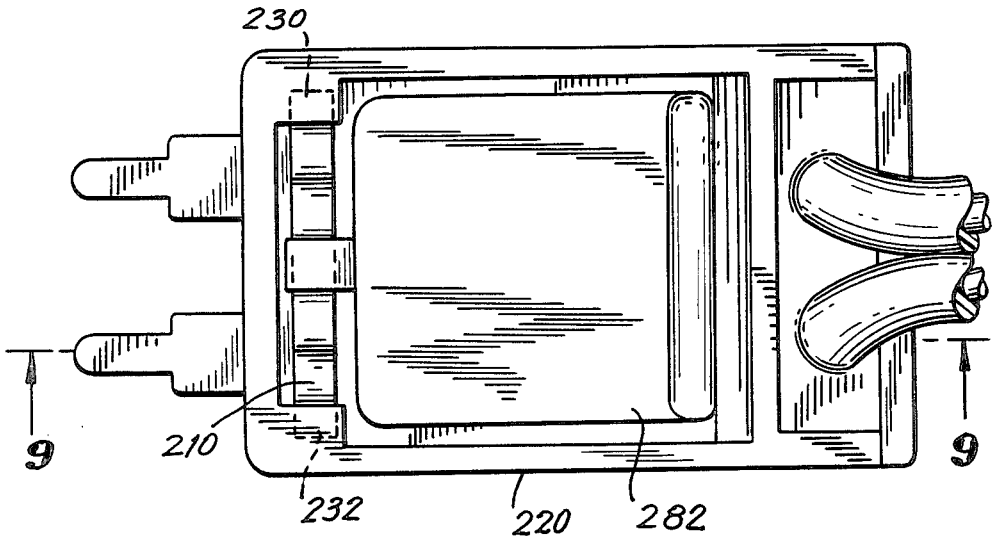
FIG. 8 is a plan view of an alternate embodiment of a magnetic switch.
Figure 9:
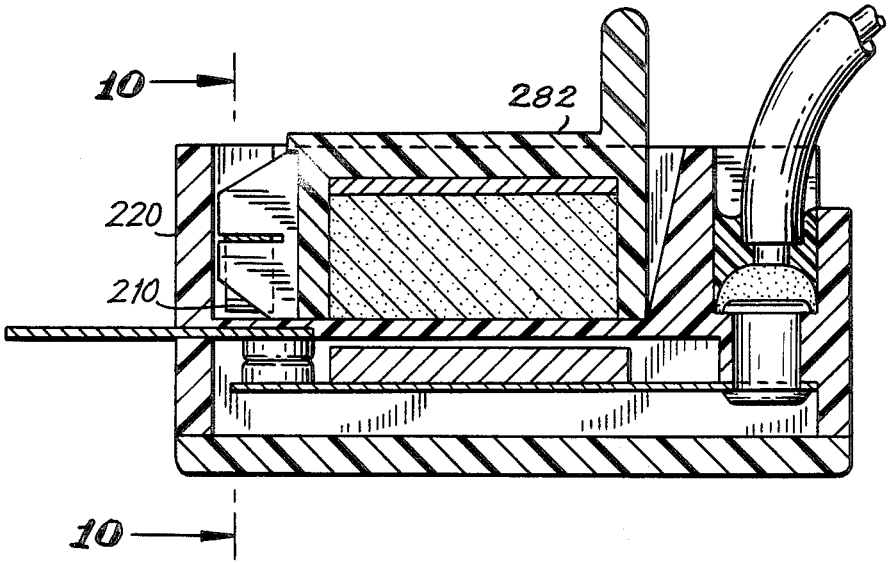
FIG. 9 is a side elevational view of FIG. 8 taken along the lines 9—9.

The operation of the magnetic switch requires a motion for magnet 82 which is provided by pivot pins 98 and 100 extending from the sides in or near rear wall 94 into apertures 102 and 104 formed into ears 75 and 76, respectively. Magnet 82 is permitted to pivot about pins 98 and 100 between a closed position as shown in FIG. 4 where the bottom surface of magnet 82 lies on the top surface of common separating wall 28 and an open position as shown in FIG. 5. The magnet is held in a normally open position by biasing spring 110 which is interposed between the rear surface of magnet 82 and transverse wall 77 of compartment 26. Spring 110 is, in the preferred embodiment, metallic and held in the loction by magnetic attraction. To overcome the normally open bias of magnetic switch 20, slide cap 16 is provided with an extension 120 having a cam projection 122 normally resting within a recess 124 of the top surface 92 of magnet holder 80 (best seen in FIG. 5). Slide cap 16 and extension 120 are limited to horizontal motion only in the direction of the arrows and it will, therefore, be understood that, as extension 120 and cam 122 are moved horizontally, cam 122 may rest in recess 124 to allow lift spring 110 to pivot the magnet away from separating wall 28 to open the switch, or cam 122 may ride on top surface 92 in order to exert downward pressure on the magnet holder to overcome the bias of lift spring 110 to move the magnet closer to separating wall 28. At a certain point in the downward pivotable motion of magnet 82 the magnetic force between the magnet and metallic plates 44 and 46 will overcome the natural bias of leaf springs 34 and 36 in order to attract metallic plates 44 and 46 upwardly thereby causing movable electrical contacts 34 and 36 to come into electrical contact with stationary contacts 56 and 58. This results in the closed position of magnetic switch 20 as shown in FIG. 4.

It has been found that under abnormal conditions (such as dropping the dryer, for example) the normal bias of leaf spring 34 and 36 may be deformed because of the inertia of the relatively massive metallic plates. This would change the set point at which the contacts close in relation to the magnet thereby possibly making the switch inoperable. To avoid this problem, ramp surfaces 60 are provided in the bottom of lower compartment 24 to act as a positive stop preventing leaf springs 34 and 36 from springing excessively beyond neutral.

An additional feature of the invention is provided by dividing wall 62 separating contact pairs 38, 56 and 40, 58 and portions of leaf springs 34 and 36 from each other. This extends the useful life of switch 20 by preventing carbon tracking due to arcing.

Another feature of the invention is that metallic plates 44 and 46 are only secured to leaf springs 34 and 36 at essentially one point. The front end of metallic plates 44 and 46 in the areas 52 and 54 are left free to be displaced from their respective leaf springs as the plates are attracted flush against the bottom of wall 28. This enables each set of contacts 38, 56 and 40, 58 to be joined with independent amounts of force as is necessary to effect satisfactory electrical contact. As shown in FIG. 4, spaces may exist in the areas 52 and 54 such that, given the natural bias of leaf springs 34 and 36, the force with which electrical contacts 38 and 40 press against their respective stationary contacts may vary.

Figure 13:
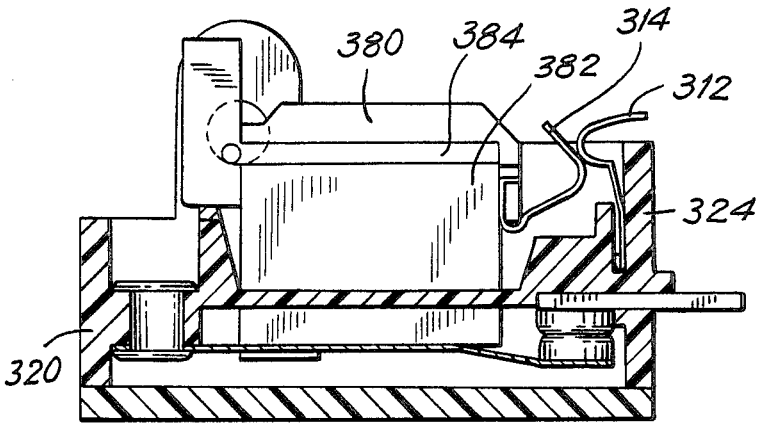
FIG. 13 is an elevational view of yet another alternate embodiment of the magnetic switch.

FIGS. 8 through 12 show one alternate embodiment of the invention in the form of magnetic switch 220. FIG. 13 shows yet another embodiment in the form of switch 320. The essential difference between previously described switch 20 and switches 220 and 320 is in the area of the upper compartment 224 and components associated with the actuation of the magnet.

Switch 220, rather than incorporating a spring which biases the magnet in only one position, utilizes a W-shaped spring 210 which is mounted in an "over-center" configuration and serves to retain the magnet in either the open or the closed position. Spring 210 is attached at each end 230 and 232 to the side walls of upper compartment 224. The center 240 of spring 210 is received within a notch 250 provided in an extension 252 at the front end of magnet holder 282. It will be understood that as cam projection 222 is moved to the extreme right as seen in FIG. 11, it will push against an upward projection 260 of magnet holder 282 causing the magnet holder to pivot about its back edge 262. This pivoting motion causes an upwardly directed force at the center 240 of spring 210 causing the spring to positively snap past its equilibrium point into the position shown in FIG. 12. The spring will retain the magnet holder in this open position until projection 222 is moved to the left (as seen in FIG. 11) to exert a downward force on the magnet holder and on the center 240 of spring 210 causing the spring to snap back over its center point into the configuration shown in FIGS. 9 and 10. The operation of the components in the lower compartment of switch 220 is, in other respects, the same as that previously described with respect to FIGS. 1–7.

In addition to the alternate embodiment of switch 220, it will be noted by those skilled in the art that various other embodiments may be utilized to move the magnet and retain it in either the open or closed position. One such embodiment is shown in switch 320 in FIG. 13. While most components of this switch are the same as those previously described, and are therefore not described or shown in detail, spring 310 is significantly different. Spring 310 comprises a part 312 secured to the front of upper compartment 324 and an abutting part 314 secured to the front of magnet holder 380. Each part 312 and 314 has a predetermined width along the abutting surfaces and is uniquely shaped to provide an over-center action to retain magnet 382 either open or closed.

It will be noted that switch 20 is provided with a "fail-safe" mechanism which is not provided by switches 220 and 320. For example, if an appliance having switch 20 is accidentally dropped with sufficient force to move the magnet down and close the switch, spring 110 will very quickly open the switch because of the normally open bias. Switches 220 and 320, since they are designed with springs that move the magnet to either one of two positions when a certain amount of force is applied to the springs, may, if the appliance is dropped, cause the magnet to move and stay in an undesired position. Additional locking means would need to be incorproated to overcome this.

It will be understood by those skilled in the art that numerous modifications and improvements may be made to the preferred embodiment of the invention disclosed herein without departing from the spirit and scope thereof.

What is claimed is:

1. A dual compartment magnetic switch comprising, a hermetically sealed first compartment comprising within said first compartment, a pair of first electrical contacts, said first contacts each having a portion thereof outside said first compartment;

a pair of longitudinally electrically conductive leaf spring means each attached at one end thereof to said compartment, said leaf spring means each having a free end normally spaced from and biased away from a respective one of said first contacts;

a pair of second electrical contacts respectively secured to the free ends of said pair of leaf spring means and adapted to be moved with said leaf spring means between a closed position in contact with a respective one of said first electrical contacts, and an open position away from same; and a pair of magnetically attractive means secured respectively to each of said leaf spring means; and further comprising an adjacent, second compartment comprising:

magnet means movable between (1) a first position wherein said magnet means will attract both of said magnetically attractive means and overcome the normal bias of said leaf spring means, thereby causing each of said pair of second electrical contacts to close with a respective one of each of said first electrical contacts, and (2) a second position wherein said magnet means will not attract both of said magnetically attractive means to thereby open the contacts;

spring means adjacent said magnet means normally biasing said magnet means into said second position, said spring means being compressible during transition of said magnet means between said first and second positions; and actuating means for selectively moving said magnet means from said second position to said first position.

2. A switch according to claim 1 wherein said spring means further comprises:

a resilient spring; and a support means fixed relative to said first compartment, said support means for providing a surface against which said resilient spring may exert tension.

3. A switch according to claims 1 or 2 further comprising pivot means to pivot said magnet means about an axis.

4. A switch according to claim 1 wherein said magnetically attractive means are generally longitudinal and secured at one end thereof to respective ones of said leaf springs and further comprising securing means for attaching said magnetically attractive means to said leaf spring means in order to enable limited movement of each of said magnetically attractive means relative to its respective leaf spring means in the plane of motion of said leaf spring means to enhance the independent operation of both pairs of first and second contacts.

5. A switch according to claim 1 further comprising a support ramp means within said first compartment adapted to limit the motion of said pair of leaf spring means away from said closed position.

6. A switch according to claim 1 further comprising a dividing wall means for isolating a predetermined portion of one of said second electrical contacts and its respective leaf spring means from the other.

7. A switch according to claim 1 wherein said first and second compartments have a common wall and wherein the side of said second compartment opposite said common wall is open.

8. A switch according to claim 1 further comprising an interconnecting member joining said leaf springs together at a point intermediate their length.

9. In a dual compartment magnetic switch comprising, in one hermetically sealed first compartment, a pair of first electrical contacts within said compartment, said first contacts having a portion thereof outside said first compartment;

a pair of pivotable arm means attached at one end thereof to said compartment, said pivotable arm means having a free end normally spaced from and biased away from said first contacts;

a pair of second electrical contacts respectively secured to the free ends of said pivotable arm means and movable by said pivotable arm means between a closed position in contact with said first electrical contacts, and an open position away from same; and magnetically attractive means secured to said pivotable arm means; and further comprising, in an adjacent, second compartment, magnet means movable between (1) a first position for attracting said magnetically attractive means and overcoming said normal bias of said pivotable arm means, thereby causing each of said pair of second electrical contacts to close with a respective one of each of said first electrical contacts, and (2) a second position to decrease the attraction between said magnet means and said magnetically attractive means to open the contacts, the improvement comprising:

spring means adjacent said magnet means releasably holding said magnet means in either said first position or said second position, said spring means being compressible during transition of said magnet means between said first and second positions; and actuating means for selectively moving said magnet means between said first and second positions.

10. A switch according to claim 9 wherein said magnet is pivotable about an axis adjacent one end thereof and wherein said spring means further comprises a W-shaped flat spring adjacent the opposite end of said magnet means and adapted to exert spring pressure in either one direction to maintain said magnet means in said first position or a second direction to maintain said magnet means in said second position.

11. A switch according to claim 9 wherein said magnet is pivotable about an axis adjacent one end thereof and wherein said spring means further comprises a pair of cooperating spring members, one spring member secured adjacent the opposite end of said magnet means and movable therewith, the other of said spring members fixedly secured relative to said second compartment, said pair of spring members adapted to exert spring pressure in either one direction to maintain said magnet means in said first position or a second direction to maintain said magnet means in said second position.

12. The improvement according to claim 11 wherein said other spring member comprises:

a first metallic member secured to said second compartment, said first metallic member being a longitudinal strip one end of which is bent into an open loop, the open end facing away from said magnet means; and wherein said one spring member comprises:

a second metallic member secured to the free end of said pivotable magnet means, said second metallic member being a strip having a predetermined width and bent into essentially three discrete sections about lines transverse to the length of said strip: a first section secured along its length to said free end of said pivotable magnet means, a second section being contiguous with said open loop of said first metallic member, a third section connecting said first and second sections.

13. A switch according to claim 2 wherein the resilient spring is metallic.

* * * * *